US009851668B2

(12) United States Patent
Kinuta

(10) Patent No.: US 9,851,668 B2
(45) Date of Patent: Dec. 26, 2017

(54) FIXING MEMBER, FIXING DEVICE, AND IMAGE FORMING APPARATUS

(71) Applicant: FUJI XEROX CO., LTD., Tokyo (JP)

(72) Inventor: Yasuhiko Kinuta, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/240,245

(22) Filed: Aug. 18, 2016

(65) Prior Publication Data

US 2017/0261893 A1 Sep. 14, 2017

(30) Foreign Application Priority Data

Mar. 10, 2016 (JP) ..... 2016-047273

(51) Int. Cl.
*G03G 15/20* (2006.01)

(52) U.S. Cl.
CPC ..... *G03G 15/206* (2013.01)

(58) Field of Classification Search
CPC . G03G 15/206; G03G 2215/2048–2215/2054; G03G 2215/2093–2215/2096
See application file for complete search history.

(56) References Cited

U.S. PATENT DOCUMENTS 4,830,893 A * 5/1989 Nakamura ..... C08L 83/04 428/35.8
5,965,243 A * 10/1999 Butler ..... G03G 5/0202 428/195.1
6,020,098 A * 2/2000 Bretscher ..... G03G 5/142 430/66
6,111,221 A * 8/2000 Miyakoshi ..... C08F 283/12 219/216
6,194,106 B1 * 2/2001 Bretscher ..... G03G 5/142 428/141
2008/0103257 A1 * 5/2008 Tokuyama ..... C08L 67/025 525/165
2012/0322967 A1 12/2012 Kondoh et al.
2016/0053056 A1 * 2/2016 Gould ..... C09D 183/10 428/447
2017/0101570 A1 * 4/2017 Iwata ..... C08L 83/04

FOREIGN PATENT DOCUMENTS

JP 2013-003419 A 1/2013

* cited by examiner

*Primary Examiner* — Clayton E Laballe
*Assistant Examiner* — Ruifeng Pu
(74) *Attorney, Agent, or Firm* — Oliff PLC

(57) ABSTRACT

According to an aspect of the invention, a fixing member includes a base material; an elastic layer that is provided on the base material and is made from a cured material of a silicone rubber composition containing a heat active catalyst and an ultraviolet ray active catalyst; and a surface layer provided on the elastic layer.

8 Claims, 4 Drawing Sheets

FIXING MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2016-047273 filed Mar. 10, 2016.

BACKGROUND

1. Technical Field

The present invention relates to a fixing member, a fixing device, and an image forming apparatus.

2. Related Art

In an image forming apparatus (copy machine, facsimile, or a printer) which uses an electrophotographic system, an unfixed toner image formed on a recording material is fixed by a fixing device, and an image is formed.

SUMMARY

According to an aspect of the invention, there is provided a fixing member including: a base material; an elastic layer that is provided on the base material, and is made from a cured material of a silicone rubber composition including a heat active catalyst and an ultraviolet ray active catalyst; and a surface layer provided on the elastic layer.

BRIEF DESCRIPTION OF THE DRAWINGS

Exemplary embodiments of the present invention will be described in detail based on the following figures, wherein.

DETAILED DESCRIPTION

Figure 1:
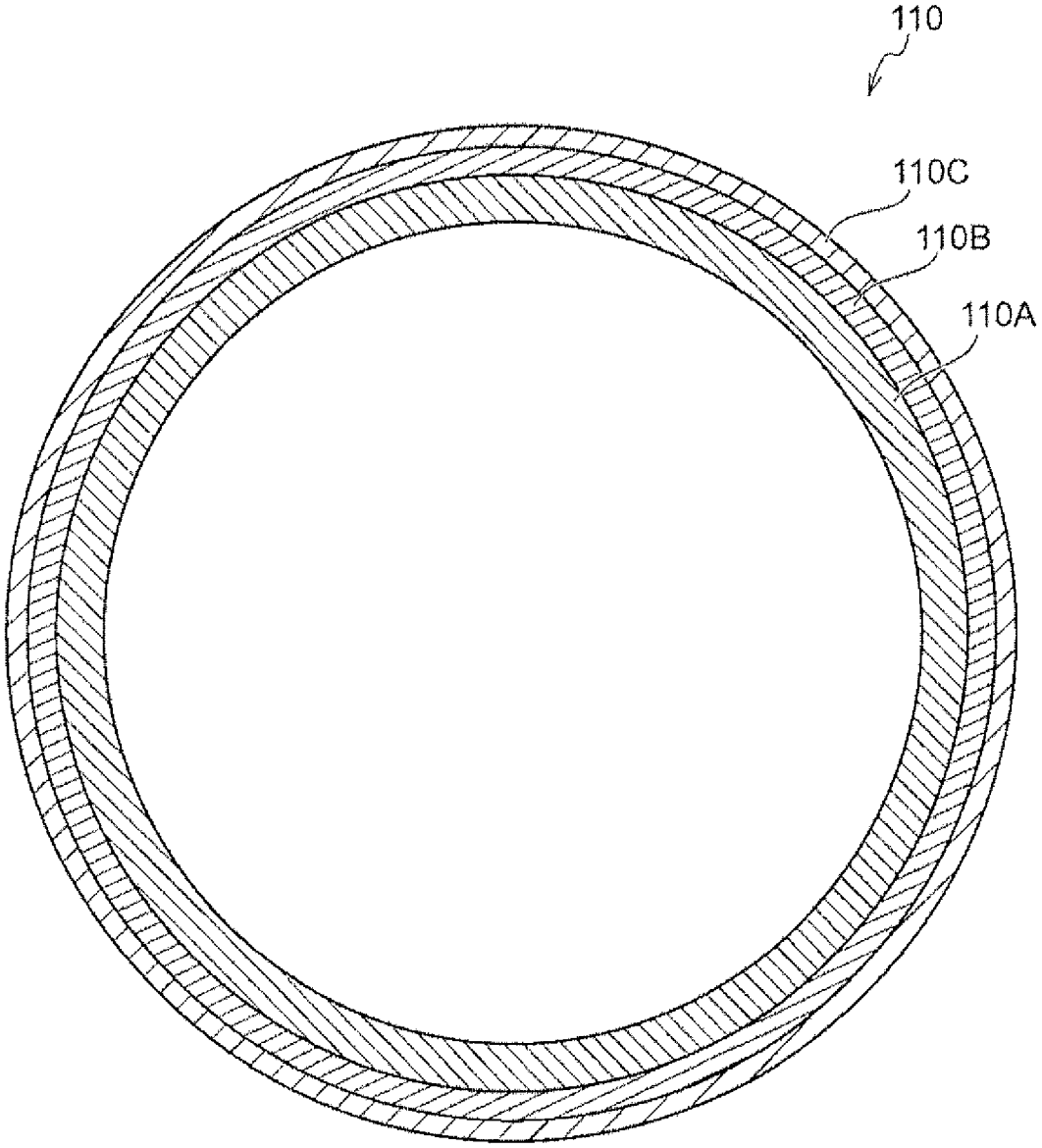
FIG. 1 is a schematic sectional view illustrating an example of a fixing member according to an exemplary embodiment.

Hereinafter, exemplary embodiments which are an example of the invention will be described.

In addition, members having practically the same function will be given the same reference numerals in all of the drawings, and overlapping description will be appropriately omitted in some cases.

[Fixing Member]

A fixing member according to the exemplary embodiment will be described.

FIG. 1 is a schematic sectional view illustrating an example of the fixing member according to the exemplary embodiment.

As illustrated in FIG. 1, a fixing member 110 according to the exemplary embodiment includes, for example, a base material 110A, an elastic layer 110B provided on the base material 110A, and a surface layer 110C provided on the elastic layer 110B. In addition, the elastic layer 110B is configured to include silicone rubber made from a cured material of a silicone rubber composition containing a heat active catalyst and an ultraviolet ray active catalyst.

In addition, the fixing member 110 according to the exemplary embodiment is not limited to the above-described layer configuration, and as necessary, for example, may have a layer configuration in which a metal layer or a protection layer is interposed between the base material 110A and the elastic layer 110B.

Here, in the related art, in the fixing member, as a member which configures the elastic layer 110B, the cured material of the thermosetting silicone rubber composition is used, and an example of a manufacturing method includes the following method.

First, after coating the base material with elastic layer forming coating liquid of a liquid silicone rubber composition including the heat active catalyst, the base material is cured, and the elastic layer is formed. Next, on the cured elastic layer, as a material which forms the surface layer, for example, a tetrafluoroethylene/perfluoroalkylvinylether copolymer (PFA) tube to which improvement processing is performed on the inner side thereof is prepared, the elastic layer is covered with the tetrafluoroethylene/perfluoroalkylvinylether copolymer (PFA) tube, and the surface layer is formed. In addition, by firing and adhering the layers, the fixing member is manufactured.

However, regarding the fixing member manufactured by the above-described manufacturing method, in particular, there is a case where an interlayer adhesive force between the elastic layer 110B and the surface layer is unlikely to be achieved, and there is a case where the interlayer adhesiveness between the elastic layer and the surface layer deteriorates. In the phenomenon, when performing the heating and drying for volatilizing the solvent contained in the elastic layer forming coating liquid, a part of the catalyst included in the elastic layer forming coating liquid becomes activated. In addition, it is considered that this is because a part (in a case where an adhesiveness imparting component is contained in the elastic layer, a part of curing reaction of the elastic layer and the reaction of the adhesiveness imparting component) of the curing reaction of the elastic layer proceeds.

Meanwhile, in order to improve an interlayer peeling strength on the base material, after forming the elastic layer forming coating film by the elastic layer forming coating liquid of the silicone rubber composition including the heat active catalyst on the base material, when coating and firing the surface layer while maintaining an uncured state, a thickness non-uniformity is generated on the elastic layer. It is considered that this is because a state of liquid dripping to the elastic layer forming coating film is generated as the elastic layer forming coating film is in an uncured state.

Meanwhile, in the fixing member 110 according to the exemplary embodiment, by providing the elastic layer which is made from the cured material of the silicone rubber composition including the heat active catalyst and the ultraviolet ray active catalyst, deterioration of the interlayer peeling strength between the adhesion layer and the surface layer is prevented, and the non-uniformity of thickness of the elastic layer is prevented.

On the base material 110A, after coating the elastic layer forming coating liquid of the silicone rubber composition including the heat active catalyst and the ultraviolet ray active catalyst and forming the elastic layer forming coating film, when emitting the ultraviolet ray (or heating), only the ultraviolet ray active catalyst (or only the heat active catalyst) is activated, the curing reaction proceeds, and a part of the elastic layer forming coating film becomes semi-cured.

After coating the elastic layer forming coating film which is in a semi-cured state with a material (for example, PFA) which becomes the surface layer 110C, by performing the firing (or by emitting the ultraviolet ray), the heat active catalyst (or the ultraviolet ray active catalyst) is activated. Accordingly, the curing reaction of the elastic layer forming coating film which is in a semi-cured state proceeds, and the cured elastic layer 110B is obtained. At this time, since the curing reaction of the elastic layer is completed in a state where the semi-cured elastic layer forming coating film and the surface layer 110C adhere to each other, deterioration of the interlayer peeling strength between the elastic layer 110B and the surface layer 110C is prevented.

Meanwhile, when the elastic layer forming coating film is in a semi-cured state, since a state of liquid dripping is prevented, the non-uniformity of thickness is prevented.

In the fixing member of the exemplary embodiment above, it is assumed that deterioration of the interlayer peeling strength between the adhesion layer and the surface layer is prevented and the non-uniformity of thickness of the elastic layer is prevented.

In addition, in order to form the elastic layer to be in an uncured state, an order of activating the heat active catalyst and the ultraviolet ray active catalyst is not particularly limited.

However, it is considered that the curing reaction proceeds by performing the heating again after stopping the curing reaction and coating the surface layer in a semi-cured state by using the silicone rubber composition including only the heat active catalyst as a catalyst. However, the curing reaction of the silicone rubber composition including only the heat active catalyst is prevented, and the elastic layer forming coating film in a stable semi-cured state is unlikely to be obtained. Meanwhile, since the elastic layer which is in a semi-cured state can be formed as the fixing member of the exemplary embodiment is configured as above, deterioration of the interlayer peeling strength between the adhesion layer and the surface layer is prevented as described above, and the non-uniformity of thickness of the elastic layer is prevented.

In addition, with respect to the fixing member made by the manufacturing method in the related art exemplified above, heating is performed twice, that is, heating for curing the elastic layer and heating after coating the surface layer. Meanwhile, according to the fixing member 110 according to the exemplary embodiment, it is also possible to prevent an increase in costs by making it possible to reduce the number of heating processes.

Hereinafter, configuration elements of the fixing member 110 according to the exemplary embodiment will be described in detail. In addition, the reference numerals will be omitted in the description.

(Shape of Fixing Member)

A fixing member according to the exemplary embodiment may have a roll shape, or may have a belt shape.

(Base Material)

In a case where the fixing member has a roll shape, an example of the base material includes a cylindrical member made from metal (aluminum, SUS, iron, or copper), an alloy, ceramics, or a fiber-reinforced metal (FRM).

In a case where the fixing member has a roll shape, the diameter and the thickness of the base material may be, for example, from 10 mm to 50 mm. For example, in a case where the fixing member is made of aluminum, the thickness is from 0.5 mm to 4 mm, and in a case where the fixing member is made of SUS (stainless steel) or iron, the thickness is from 0.1 mm to 2 mm.

Meanwhile, in a case where the fixing member has a belt shape, examples of the base material include a metal belt (for example, a metal belt made of nickel, aluminum, or stainless steel), and a resin belt (for example, a resin belt made of polyimide, polyamide-imide, polyphenylene sulfide, polyetheretherketone, or polybenzimidazole).

In addition, conductive powder or the like may be added into and dispersed in the resin belt, and volume resistivity may be added. A specific example of the resin belt includes a polyimide belt in which carbon black is added and dispersed and volume resistivity is controlled. In addition, examples of the resin belt include a belt-shaped one in which both end portions of a long polyimide sheet are combined with each other and are thermo-press bonded by using a thermo-press bonding member.

In a case where the fixing member has a belt shape, thickness of the base material may be, for example, from 20 μm to 200 μm, preferable from 30 μm to 150 μm, and more preferably from 40 μm to 130 μm.

(Elastic Layer)

The elastic layer is made from the cured material of the silicone rubber composition including the heat active catalyst and the ultraviolet ray active catalyst. An example of the silicone rubber composition is a composition containing organo-polysiloxane in which two or more alkenyl groups are included in one molecule, organo-hydrogen polysiloxane in which two or more SiH groups are included in one molecule, the heat active catalyst, and the ultraviolet ray active catalyst.

The organo-polysiloxane in which two or more alkenyl groups are included in one molecule is not particularly limited, and a known material can be used.

Specific examples of the organo-polysiloxane include dimethylsiloxane/methylvinylsiloxane copolymer having both molecular chain ends blocked with trimethylsilyl groups, methylvinylpolysiloxane having both molecular chain ends blocked with trimethylsiloxy groups, dimethylsiloxane/methylvinylsiloxane/methylphenylsiloxane copolymer having both molecular chain ends blocked with trimethylsiloxane groups, dimethylpolysiloxane having both molecular chain ends blocked with dimethylvinylsiloxane groups, methylvinylpolysiloxane having both molecular chain ends blocked with dimethylvinylsiloxane groups, dimethylsiloxane/methylvinylsiloxane copolymer having both molecular chain ends blocked with dimethylvinylsiloxane groups, dimethylsiloxane/methylvinylsiloxane/methylphenylsiloxane copolymer having both molecular chain ends blocked with dimethylvinylsiloxane groups, dimethylpolysiloxane having both molecular chain ends blocked with divinylmethylsiloxane groups, dimethylsiloxane/methylvinylsiloxane copolymer having both molecular chain ends blocked with divinylmethylsiloxane groups, dimethylpolysiloxane having both molecular chain ends blocked with trivinylsiloxane groups, and dimethylsiloxane/methylvinylsiloxane copolymer having both molecular chain ends blocked with trivinylsiloxane groups.

Organo-polysiloxane may be used alone or in combination of two or more kinds thereof.

The organo-hydrogen polysiloxane in which two or more SiH groups are included in one molecule is not particularly limited, and a known material can be used.

Specific examples of the organo-hydrogen polysiloxane include 1,1,3,3-tetramethyldisiloxane, 1,3,5,7-tetramethylcyclotetrasiloxane, methylhidrogen cyclopolysiloxane, methylhydrodienesiloxane/dimethylsiloxane cyclic copolymer, tris(dimethylhydrogensiloxy)methylsilane, tris(dimethylhydrogensiloxy)phenylsilane, methylhydrogenpolysiloxane having both ends blocked with trimethylsiloxane groups, dimethylsiloxane/methylhydrogensiloxane copolymer having both molecular chain ends blocked with trimethylsiloxane groups, dimethylpolysiloxane having both molecular chain ends blocked with dimethylhydrogensiloxane groups, dimethylsiloxane/methylhydrogensiloxane copolymer having both molecular chain ends blocked with dimethylhydrogensiloxane groups, methylhydrogensiloxane/diphenylsiloxane copolymer having both molecular chain ends blocked with trimethylsiloxane groups, methylhydrogensiloxane/diphenylsiloxane/dimethylsiloxane copolymer having both molecular chain ends blocked with trimethylsiloxane groups, cyclic methylhydrogenpolysiloxane, cyclic methylhydrogensiloxane/dimethylsiloxane copolymer, and cyclic methylhydrogensiloxane/diphenylsiloxane/dimethylsiloxane copolymer.

The organo-hydrogen polysiloxane may be used alone or in combination of two or more kinds thereof.

The heat active catalyst is a catalyst which is activated by the heating, and is a catalyst which is not activated by the irradiation of the ultraviolet ray. The heat active catalyst is not particularly limited as long as the heat active catalyst is a catalyst which is activated by heating. An example of the heat active catalyst includes platinum group metal or a compound of platinum group metal. Specific examples of the heat active catalyst include: platinum group metal, such as platinum, palladium, or rhodium; platinic chloride; alcohol-modified platinic chloride; coordination compound of platinic chloride and vinylsiloxane or acetylene compound of olefin; tetrakis(triphenylphosphine)palladium; and chlorotris(triphenylphosphine)rhodium. The heat active catalyst may be used alone or in combination of two or more kinds thereof.

The ultraviolet ray active catalyst is a catalyst which is activated by the irradiation of the ultraviolet ray, and is a catalyst which is not activated by the heating. The ultraviolet ray active catalyst is not particularly limited as long as the ultraviolet ray active catalyst is a catalyst which is activated by the irradiation of the ultraviolet ray. As the ultraviolet ray active catalyst, platinum group metal and a compound of platinum group metal, or nickel compound are employed, but the platinum group metal and the compound of platinum group metal are preferable. Specific examples of the ultraviolet ray active catalyst include: β-diketone platinum complex, such as trimethyl(acetylacetonate)platinum complex, trimethyl(3,5-heptane dionate)platinum complex, trimethyl (methylacetoacetate)platinum complex, bis(2,4-pentane dionato)platinum complex, bis(2,4-hexane dionato)platinum complex, bis(2,4-heptane dionato)platinum complex, bis(3,5-heptane dionato)platinum complex, bis(1-phenyl-1,3-butane dionato)platinum complex, and bis(1,3-diphenyl-1,3-propane dionato)platinum complex; and platinum complex containing cyclic diene compound in ligand, such as (methylcyclopentadienyl)trimethyl platinum complex, (methylcyclopentadienyl)trihexyl platinum complex, (trimethylsilylcyclopentadienyl)trimethyl platinum complex, (trimethylsilylcyclopentadienyl)trihexyl platinum complex, (dimethylphenylsilylcyclopentadienyl)triphenyl platinum complex, and (cyclopentadienyl)dimethyltrimethylsilylmethyl platinum complex. The ultraviolet ray active catalyst may be used alone or in combination of two or more kinds thereof.

Among these, it is preferable to use the β-diketone platinum complex as the ultraviolet ray active catalyst from the viewpoint of preventing deterioration of the interlayer peeling strength between the adhesion layer and the surface layer.

A weight ratio (a/b) of an amount (a) of the heat active catalyst and an amount (b) of the ultraviolet ray active catalyst is preferably 0.2 or more from the viewpoint of preventing deterioration of the interlayer peeling strength between the adhesion layer and the surface layer and preventing the thickness unevenness of the elastic layer. The weight ratio is more preferably from 0.2 to 5, and still more preferably from 1 to 2.

In addition, the total amount of the amount (a) of the heat active catalyst contained in the silicone rubber composition and the amount (b) of the ultraviolet ray active catalyst is not limited as long as the total amount is an effective amount as a catalyst, but an example thereof is a range of 0.1 ppm to 5,000 ppm with respect to the silicone rubber composition.

Since the elastic layer is made from the cured material of the above-described silicone rubber composition, the heat active catalyst and the ultraviolet ray active catalyst are contained in the elastic layer. The heat active catalyst and the ultraviolet ray active catalyst which are contained in the elastic layer are obtained by an inductively coupled plasma atomic emission spectrophotometry (ICP).

The silicone rubber composition for forming the elastic layer may contain an adhesiveness imparting component. In other words, the adhesiveness imparting component may be contained in the silicone rubber composition. An example of the adhesiveness imparting component includes an alkoxysilane compound. An example of the alkoxysilane compound includes a functional group-containing alkoxyalkoxysilane compound containing functional groups, such as a vinyl group, an epoxy group, and a (meth)acryloxy group ("(meth)acryloxy" includes acryloxy and methacryloxy). Specific examples of the adhesiveness imparting component include glycidoxypropyltriethoxysilane, vinyltrimethoxysilane, vinyltriethoxysilane, glycidoxypropyltrimethoxysilane, glycidoxypropylmethyldiethoxysilane, methacryloxypropylmethyldiethoxysilane, methacryloxypropyltriethoxysilane, and allyltriethoxysilane.

A content of the adhesiveness imparting component is not particularly limited, but may be from 0.5% by weight to 20% by weight with respect to the entire solid content of the adhesion layer.

Various types of additives may be mixed into the material which configures the elastic layer. Examples of the additives include a reinforcing agent (carbon black or the like), a filler (calcium carbonate or the like), a softner (paraffin material or the like), a processing auxiliary agent (stearic acid or the like), an anti-aging agent (amine material or the like), vulcanizing agent (sulfur, metal oxide, peroxide, or the like), and a functional filler (alumina or the like).

The thickness of the elastic layer may be, for example, from 30 μm to 1 mm, and more preferably from 100 μm to 500 μm.

(Surface Layer)

The surface layer includes, for example, a heat resistant releasing material.

Examples of the heat resistant releasing material includes a fluororubber, a fluorine resin, a silicone resin, and a polyimide resin.

Among these, as the heat resistant releasing material, the fluorine resin may be employed. Wrinkles are likely to be generated when making the surface layer including the fluorine oresin thin, but in the exemplary embodiment, wrinkles of the surface layer are prevented.

Specific examples of the fluorine resin include a tetrafluoroethylene/perfluoroalkylvinylether copolymer (PFA), polytetrafluoroethylene (PTFE), a tetrafluoroethylene/ hexafluoropropylene copolymer (FEP), a polyethylene/tetrafluoroethylene copolymer (ETFE), polyvinylidene fluoride (PVDF), polychlorotrifluoroethylene (PCTFE), and vinyl fluoride (PVF).

The thickness of the surface layer is equal to or less than 100 μm, but for example, may be from 5 μm to 50 μm, and preferably from 10 μm to 40 μm.

In addition, in a tube for forming the surface layer, in order to enhance the adhesiveness between the adhesion layer and the surface layer, adhesion processing may have been performed in advance on an inner surface. Examples of the adhesion processing include liquid ammonia processing, sodium-naphthalene processing, excimer laser processing, and plasma processing.

Next, the manufacturing method of the fixing member will be described.

The manufacturing method of the fixing member includes: a process of forming the elastic layer forming coating film by coating the base material with the elastic layer forming coating liquid of the silicone rubber composition including the heat active catalyst and the ultraviolet ray active catalyst; a process of emitting the ultraviolet ray or firing; a process of coating the elastic layer forming coating film with the surface layer; and a process of firing or emitting the ultraviolet ray.

Hereinafter, the manufacturing method of the fixing member will be specifically described, but the invention is not limited thereto.

First, as the base material, for example, a belt-shaped base material is prepared.

Next, the elastic layer forming coating film is formed by coating the prepared base material with the elastic layer forming coating liquid of the silicone rubber composition including the heat active catalyst and the ultraviolet ray active catalyst by a known method, such as a blade coating method. The elastic layer forming coating film becomes semi-cured by irradiating the coating film with the ultraviolet ray. The ultraviolet ray may be emitted by an ultraviolet ray emitting machine provided with a light source which generates known ultraviolet ray, such as a mercury vapor lamp, a metal halide lamp, or a light-emitting diode (LED) element. The quantity of the emitted ultraviolet ray is not particularly limited as long as the quantity is sufficient for curing the adhesion layer forming coating film, and an example of the accumulated quantity of ray is from 1,000 $mJ/cm^2$ to 10,000 $mJ/cm^2$.

Next, the semi-cured elastic layer forming coating film is coated with a tube-shaped member (tube) manufactured by using a heat resistant releasing material which becomes the surface layer. After coating the film with the tube, the firing is performed, the curing reaction of the semi-cured elastic layer forming coating film proceeds, and the film is cured. Accordingly, the elastic layer made from the cured material of the silicone rubber composition is obtained. In addition, the firing condition is not particularly limited as along as the firing condition is a condition on which the semi-cured elastic layer forming coating film is cured. An example of the firing condition includes a range of 100° C. to 230° C.

In addition, a manufacturing process is described in order of emitting the ultraviolet ray, coating the surface layer, and performing the firing after forming the elastic layer forming coating film, but the order of emitting the ultraviolet ray and performing the firing may be changed. In other words, the fixing member may be manufactured in order of performing the firing, coating the surface layer, and emitting the ultraviolet ray after forming the elastic layer forming coating film.

The fixing member is obtained through the above-described processes.

(Use of Fixing Member)

The fixing member according to exemplary embodiment is employed, for example, in any of a heating belt and a pressure belt. In addition, the heating belt may be any of a heating belt which performs the heating by an electromagnetic induction system, and a heating belt which performs the heating from an external heat source.

However, in a case where the fixing member according to the exemplary embodiment is employed in the heating belt which performs the heating by the electromagnetic induction system, a metal layer (heat generating layer) which generates the heat by the electromagnetic induction may be provided between the base material and the elastic layer.

[Fixing Device]

A fixing device according to the exemplary embodiment has various configuration elements, and for example, includes a first rotating member and a second rotating member disposed to contact with the outer surface of the first rotating member. In addition, as at least one of the first rotating member and the second rotating member, the fixing member according to exemplary embodiment is employed.

Hereinafter, as the first and the second exemplary embodiments, the fixing device provided with the heating belt and a pressure roll will be described. In addition, in the first and the second exemplary embodiments, the fixing member according to the exemplary embodiment can also be employed in any of the heating belt and the pressure roll.

In addition, the fixing device according to the exemplary embodiment is not limited to the first and the second exemplary embodiments, and may be a fixing device provided with a heating roll or the heating belt, and the pressure belt. In addition, the fixing member according to the exemplary embodiments, can also be employed in any of the heating roll, the heating belt, and the pressure belt.

In addition, the fixing device according to the exemplary embodiment is not limited to the first and the second exemplary embodiments, and may be a fixing device of an electromagnetic induction heating system.

(First Exemplary Embodiment of Fixing Device)

Figure 2:
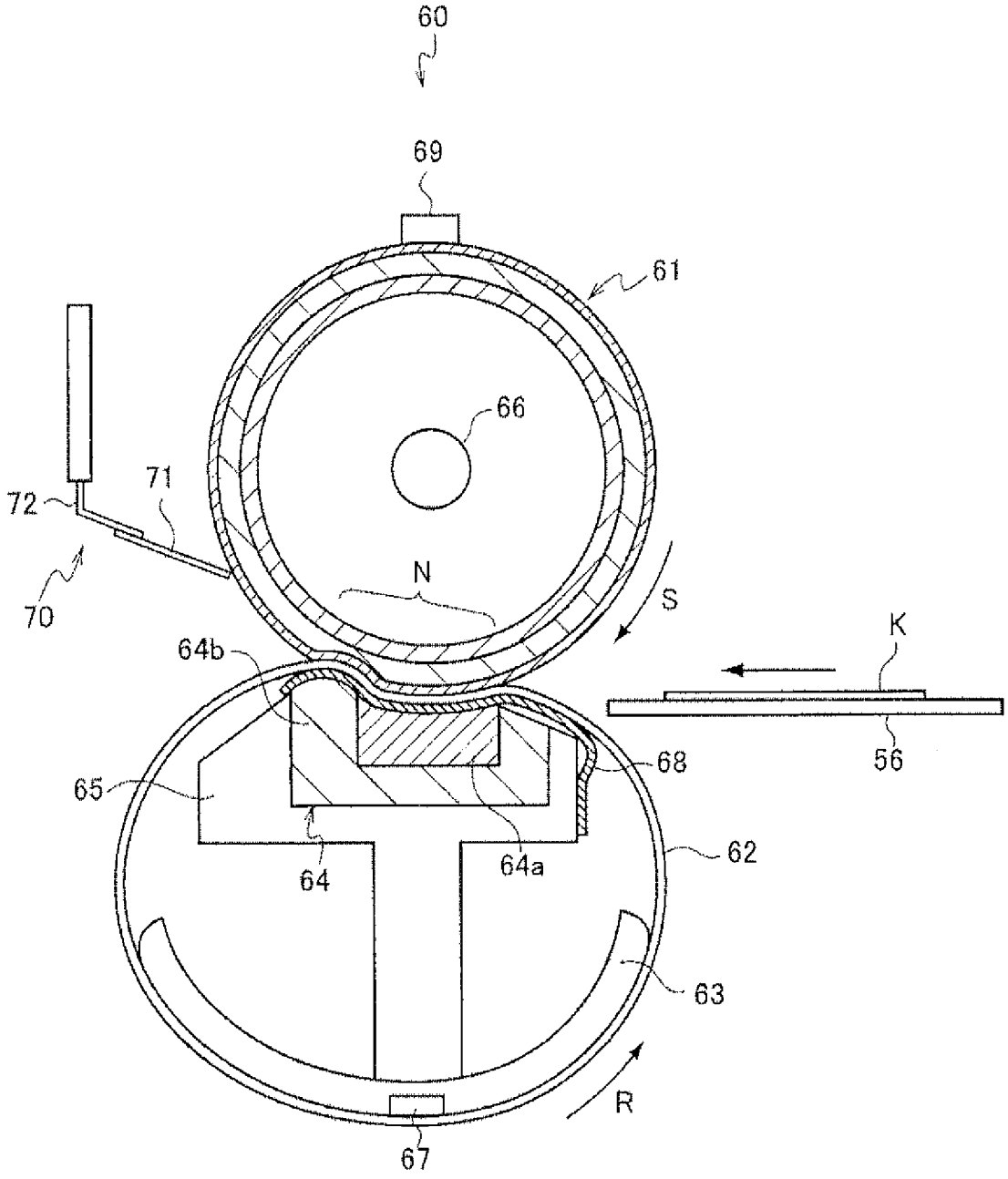
FIG. 2 is a schematic configuration view illustrating an example of a fixing device according to a first exemplary embodiment.

The fixing device according to the first exemplary embodiment will be described. FIG. 2 is a schematic view illustrating an example of the fixing device according to the first exemplary embodiment.

As illustrated in FIG. 2, a fixing device 60 according to the first exemplary embodiment includes, for example, a heating roll 61 (an example of the first rotating member) which is driven to rotate, a pressure belt 62 (an example of the second rotating member), and a pressing pad 64 (an example of the pressing member) which presses the heating roll 61 via the pressure belt 62.

In addition, for example, the pressure belt 62 and the heating roll 61 may relatively pressurize the pressing pad 64. Therefore, the pressure belt 62 side may be pressurized to the heating roll 61, and the heating roll 61 side may be pressurized to the heating roll 61.

A halogen lamp 66 (an example of a heating unit) is installed on the inside of the heating roll 61. The heating unit is not limited to the halogen lamp, and other heat generating members which generate the heat may be employed.

Meanwhile, for example, a thermosensitive element 69 is disposed to contact with the surface of the heating roll 61. Based on a temperature measured value by the thermosensitive element 69, light of the halogen lamp 66 is controlled, and the set temperature (for example, 150° C.) which is a target of the surface temperature of the heating roll 61 is maintained.

The pressure belt 62 is supported to be freely rotated, for example, by the pressing pad 64 and a belt travel guide 63 which are disposed on the inside thereof. In addition, the pressure belt 62 is disposed to be pressed with respect to the heating roll 61 by the pressing pad 64 in a nip region N (nip portion).

The pressing pad 64, for example, is disposed in a state of being pressurized to the heating roll 61 via the pressure belt 62 on the inner side of the pressure belt 62, and forms the nip region N between the pressing pad 64 and the heating roll 61.

The pressing pad 64, for example, disposes a front nip member 64*a* for ensuring the nip region N having wide width on an inlet side of the nip region N, and disposes a peeling nip member 64*b* for giving strain to the heating roll 61 on an outlet side of the nip region N.

In order to reduce sliding resistance between the inner circumferential surface of the pressure belt 62 and the pressing pad 64, for example, a sheet-shaped sliding member 68 is provided on a surface on which the front nip member 64*a* and the pressure belt 62 of the peeling nip member 64*b* are in contact with each other, is provided. In addition, the pressing pad 64 and the sliding member 68 are held by a metal holding member 65.

In addition, in the sliding member 68, for example, the sliding surface thereof is provided to contact with the inner circumferential surface of the pressure belt 62, and is involved with holding and supplying oil which is present between the sliding member 68 and the pressure belt 62.

The belt travel guide 63 is attached to the metal holding member 65, for example, and the pressure belt 62 is configured to rotate.

The heating roll 61, for example, rotates in the arrow S direction by a driving motor which is not illustrated, and the pressure belt 62 which is driven by the rotation rotates in the arrow R direction which is opposite to the rotational direction of the heating roll 61. In other words, for example, while the heating roll 61 rotates in the clockwise direction in FIG. 2, the pressure belt 62 rotates in the counterclockwise direction.

In addition, a paper sheet K (an example of a recording medium) which has an unfixed toner image, is guided by a fixing inlet guide 56, and is transported to the nip region N. In addition, when the paper sheet K passes through the nip region N, the toner image on the paper sheet K is fixed by the pressure and heat which act in the nip region N.

In the fixing device 60 according to the first exemplary embodiment, for example, by the recessed front nip member 64*a* following the outer circumferential surface of the heating roll 61, compared to a configuration in which the front nip member 64*a* is not provided, wide nip region N is ensured.

In addition, in the fixing device 60 according to the first exemplary embodiment, for example, by disposing the peeling nip member 64*b* by making the peeling nip member 64*b* protrude to the outer circumferential surface of the heating roll 61, strain of the heating roll 61 locally increases in an outlet region of the nip region N.

When the peeling nip member 64*b* is disposed in this manner, for example, when the paper sheet K after the fixing passes through the peeling nip region, since the paper sheet K passes through the strain which is formed to be locally large, the paper sheet K is likely to be peeled from the heating roll 61.

As an auxiliary unit for the peeling, for example, a peeling member 70 is installed on the downstream side of the nip region N of the heating roll 61. In the peeling member 70, for example, a separation claw 71 is held by a holding member 72 in a state of being close to the heating roll 61 in the orientation (counter direction) of opposing the rotational direction of the heating roll 61.

(Second Exemplary Embodiment of Fixing Device)

Figure 3:
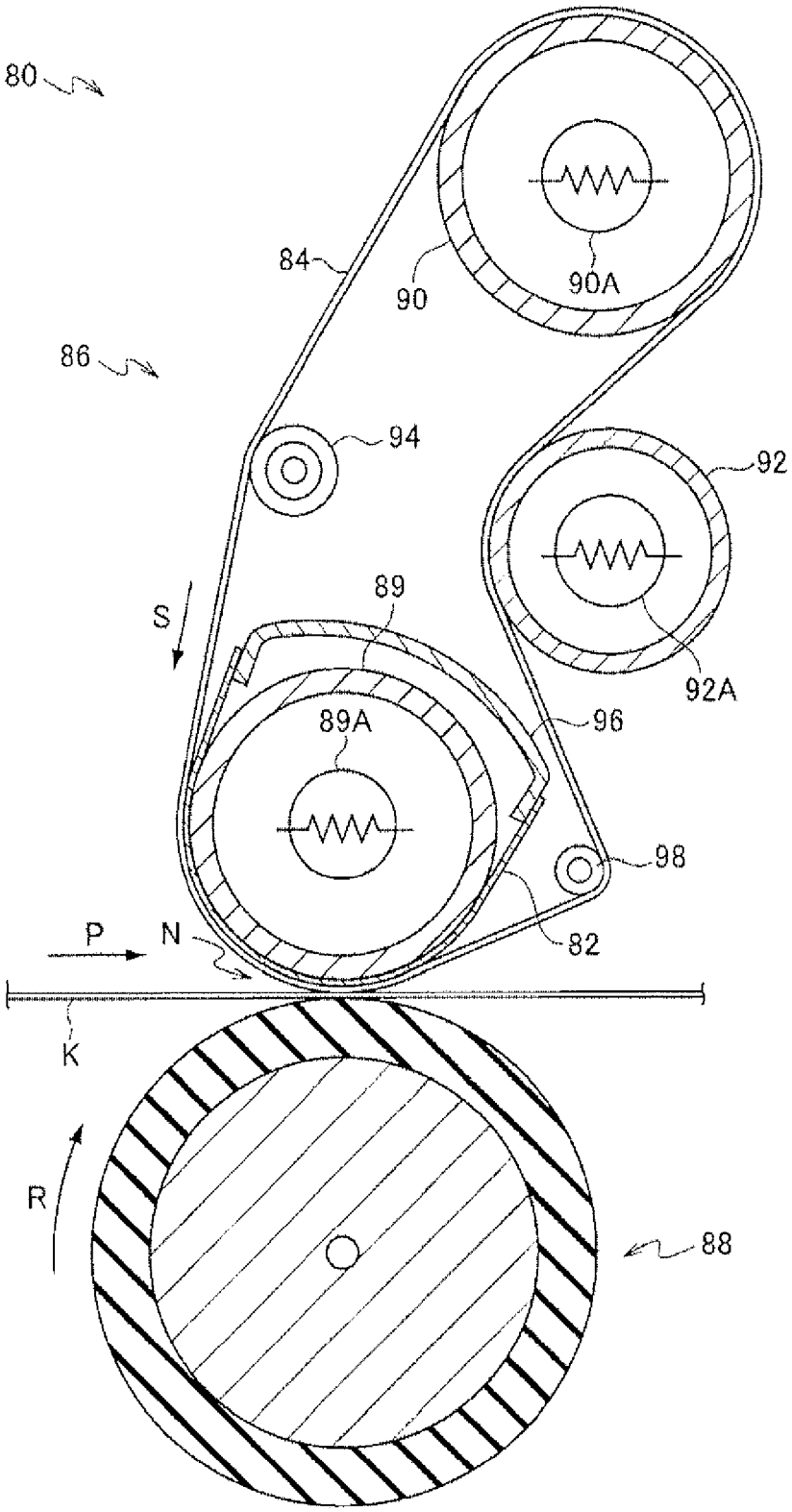
FIG. 3 is a schematic configuration view illustrating an example of the fixing device according to a second exemplary embodiment.

The fixing device according to the second exemplary embodiment will be described. FIG. 3 is a schematic view illustrating an example of the fixing device according to the second exemplary embodiment.

As illustrated in FIG. 3, a fixing device 80 according to the second exemplary embodiment includes, for example, a fixing belt module 86 provided with a heating belt 84 (an example of the first rotating member), and a pressure roll 88 (an example of the second rotating member) which is disposed to be pressed to the heating belt 84 (fixing belt module 86). In addition, for example, the nip region N (nip portion) in which the heating belt. 84 (fixing belt module 86) and the pressure roll 88 come into contact with each other, is formed. In the nip region N, the paper sheet K (an example of the recording medium) is pressurized and heated, and the toner image is fixed.

The fixing belt module 86 includes, for example, the endless heating belt 84, a heating pressing roll 89 around which the heating belt 84 is wound on the pressure roll 88 side, and which is driven to rotate by a rotating force of the motor (not illustrated) and presses the heating belt 84 from the inner circumferential surface to the pressure roll 88 side, and a support roll 90 which supports the heating belt 84 from the inner side at a position different from the heating pressing roll 89.

The fixing belt module 86 includes, for example, a support roll 92 which is disposed on the outside of the heating belt 84, and regulates a circulating path thereof, a posture correcting roll 94 which corrects the posture of the heating belt 84 from the heating pressing roll 89 to the support roll 90, and a support roll 98 which imparts tension to the heating belt 84 from the inner circumferential surface on the downstream side of the nip region N which is a region in which the heating belt 84 (fixing belt module 86) and the pressure roll 88 come into contact with each other.

In addition, the fixing belt module 86 is provided so that a sheet-shaped sliding member 82 is interposed, for example, between the heating belt 84 and the heating pressing roll 89.

In the sliding member 82, for example, the sliding surface thereof is provided to contact with the inner circumferential surface of the heating belt 84, and is involved with holding and supplying oil which is present between the sliding member 82 and the heating belt 84.

Here, the sliding member 82 is provided, for example in a state where both ends thereof are supported by a support member 96.

On the inside of the heating pressing roll 89, for example, a halogen heater 89A (an example of the heating unit) is provided.

The support roll 90 is, for example, a cylindrical roll formed of aluminum, a halogen heater 90A (an example of the heating unit) is provided on the inside thereof, and the heating belt 84 is heated from the inner circumferential surface side.

In both end portions of the support roll 90, for example, a spring member (not illustrated) which presses the heating belt 84 to the outside is installed.

The support roll 92 is, for example, a cylindrical roll formed of aluminum, and a release layer made of fluorine resin having a thickness of 20 μm is formed on the surface of the support roll 92.

The release layer of the support roll 92 is, for example, formed for preventing toner or paper powder from the outer circumferential surface of the heating belt 84 from being accumulated in the support roll 92.

On the inside of the support roll 92, for example, a halogen heater 92A (an example of a heating source) is installed, and heats the heating belt 84 from the outer circumferential surface side.

In other words, for example, a configuration in which the heating belt 84 is heated by the heating pressing roll 89, the support roll 90, and the support roll 92, is achieved.

The posture correcting roll 94 is, for example, a columnar roll formed of aluminum, and the end portion position measuring mechanism (not illustrated) which measures the end portion position of the heating belt 84 is disposed near the posture correcting roll 94.

In the posture correcting roll 94, for example, a shaft displacement mechanism (not illustrated) which displaces an abutting position in the shaft direction of the heating belt 84 in accordance with the measurement result of the end portion position measuring mechanism, and belt walk of the heating belt 84 is controlled.

Meanwhile, the pressure roll 88 is, for example, supported to be freely rotated, and is provided to be pressed to a part at which the heating belt 84 is wound around the heating pressing roll 89 by a biasing unit, such as a spring which is not illustrated. Accordingly, as the heating belt 84 (heating pressing roll 89) of the fixing belt module 86 rotates and moves in the arrow S direction, the pressure roll 88 rotates and moves in the arrow R direction following the heating belt 84 (heating pressing roll 89).

In addition, when the paper sheet K having the unfixed toner image (not illustrated) is transported in the arrow P direction, and guided to the nip region N of the fixing device 80, and the image is fixed by the pressure and the heat which act in the nip region N.

In addition, in the fixing device 80 according to the second exemplary embodiment, an aspect in which the halogen heater (halogen lamp) is employed as an example of the heating source, but the invention is not limited thereto, and radiation lamp heat-generating member (heat-generating member which generates a radiation ray (infrared light or the like)) and a resistance heat-generating member (heat-generating member which generates Joule heat by making the current flow to a resistor, for example, a heat-generating member which forms and fires a film having a thick film resistor on a ceramic substrate) may be employed other than the halogen heater.

[Image Forming Apparatus]

Next, an image forming apparatus according to the exemplary embodiment will be described.

The image forming apparatus according to the exemplary embodiment includes: an image holding member; a charging unit that charges a surface of the image holding member; a latent image forming unit that forms a latent image on a charged surface of the image holding member; a developing unit that develops the latent image by a toner to form a toner image; a transfer unit that transfers the toner image to a recording medium; and a fixing unit that fixes the toner image on the recording medium. In addition, as the fixing unit, the fixing device according to the exemplary embodiment is employed.

Hereinafter, the image forming apparatus according to the exemplary embodiment will be described with reference to the drawings.

Figure 4:
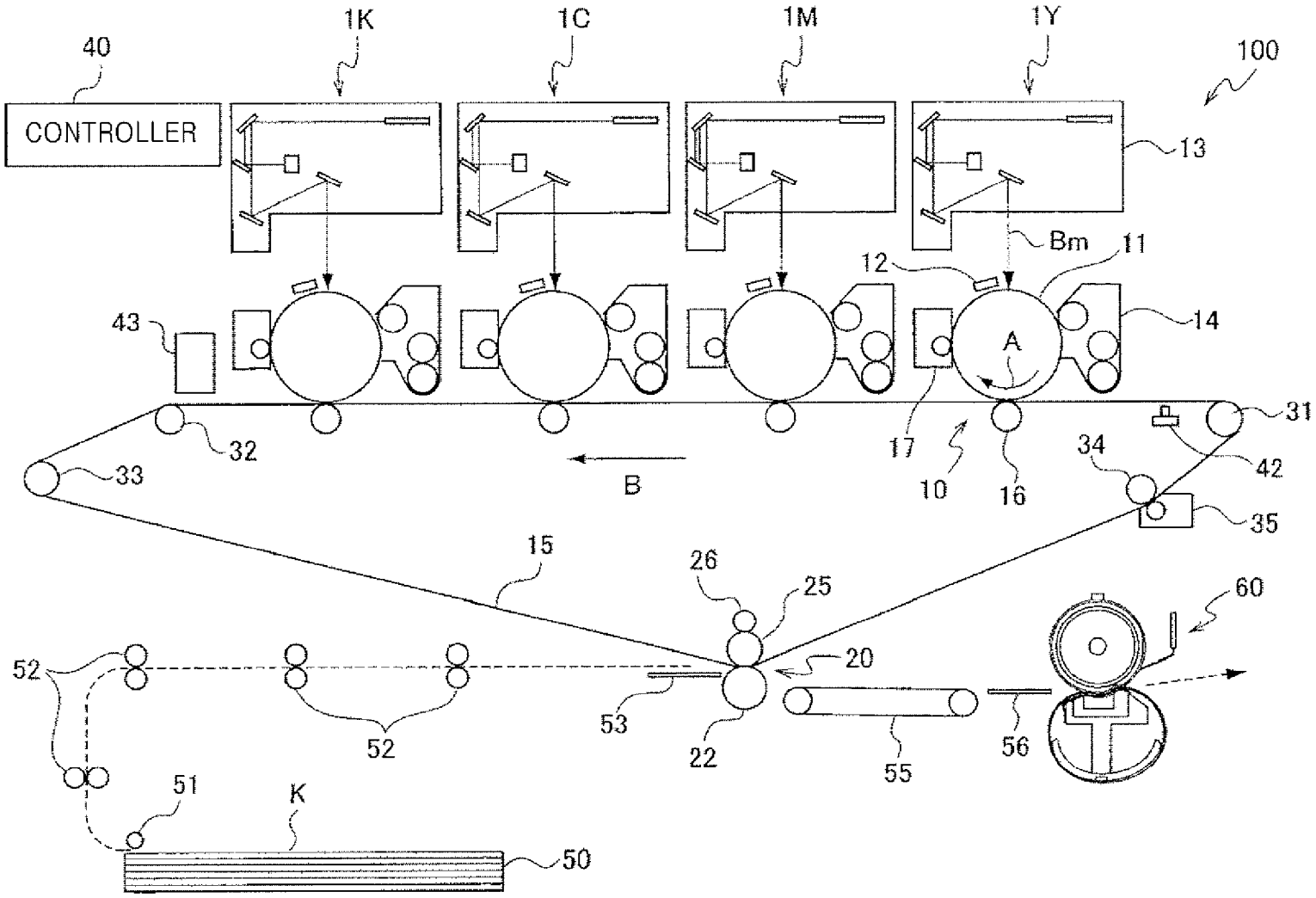
FIG. 4 is a schematic configuration view illustrating an example of an image forming apparatus according to the exemplary embodiment.

FIG. 4 is a schematic configuration view illustrating a configuration of the image forming apparatus according to the exemplary embodiment.

As illustrated in FIG. 4, an image forming apparatus 100 according to the exemplary embodiment is an intermediate transfer image forming apparatus which is generally called a tandem type, and includes: plural image forming units 1Y, 1M, 1C, and 1K in which the toner images of each color component is formed by a electrophotographic system; a primary transfer portion 10 that sequentially transfers (primarily transfers) the toner images of each color component formed by each of the image forming units 1Y, 1M, 1C, and 1K to an intermediate transfer belt 15; a secondary transfer portion 20 that integrally transfers (secondarily transfers) the superimposed toner images transferred onto the intermediate transfer belt 15 to the paper sheet K which is a recording medium; and the fixing device 60 that fixes the secondarily transferred image onto the paper sheet K. In addition, the image forming apparatus 100 includes a controller 40 that controls operations of each device (each portion).

The fixing device 60 is the fixing device 60 according to the first exemplary embodiment described above. In addition, the image forming apparatus 100 may be configured to include the fixing device 80 according to the second exemplary embodiment described above.

Each of the image forming units 1Y, 1M, 1C, and 1K of the image forming apparatus 100 is provided with a photoreceptor 11 which rotates in the arrow A direction as an example of an image holding member which holds the toner image formed on the surface.

On the periphery of the photoreceptor 11, a charging member 12 which charges the photoreceptor 11 is provided as an example of the charging unit, and a laser exposure member 13 (exposure beam is illustrated by a reference numeral Bm in the drawing) which writes an electrostatic latent image on the photoreceptor 11 is provided as an example of the latent image forming unit.

In addition, on the periphery of the photoreceptor 11, a developing device 14 in which the toner of each color component is contained, and which visualizes the electrostatic latent image on the photoreceptor 11 by the toner is provided as an example of the developing unit, and a primary transfer roll 16 which transfers the toner images of each color component formed on the photoreceptor 11 to the intermediate transfer belt 15 by the primary transfer portion 10 is provided.

Furthermore, on the periphery of the photoreceptor 11, a photoreceptor cleaning unit 17 which removes residual toner on the photoreceptor 11 is provided, and an electrophotographic devices of the charging member 12, the laser exposure member 13, the developing device 14, the primary transfer roll 16, and the photoreceptor cleaning unit 17 are sequentially installed along the rotating direction of the photoreceptor 11. The image forming units 1Y, 1M, 1C, and 1K are disposed in a shape of a substantially straight line in an order of yellow (Y), magenta (M), cyan (C), and black (K) from the upstream side of the intermediate transfer belt 15.

The intermediate transfer belt 15 which is an intermediate transfer member is configured of a film-shaped pressure belt which considers a resin, such as polyimide or polyamide as a base layer, and which contains an appropriate amount of antistatic agent, such as carbon black. In addition, the volume resistivity is $10^6$ Ωcm to $10^{14}$ Ωcm, and the thickness is, for example, approximately 0.1 mm.

The intermediate transfer belt 15 is driven to circulate (rotate) at speed which corresponds to the target in the B direction illustrated in FIG. 4 by various rolls. Examples of the various rolls include: a driving roll 31 that is driven by a motor (not illustrated) having excellent constant speed properties, and rotates the intermediate transfer belt 15; a support roll 32 that supports the intermediate transfer belt 15 which extends in a shape of a substantially straight line along the direction of arrangement of each photoreceptor 11; a tension imparting roll 33 that imparts tension to the intermediate transfer belt 15, and functions as a correction roll which prevents the belt walk of the intermediate transfer belt 15; a rear surface roll 25 that is provided in the secondary transfer portion 20; and a cleaning rear surface roll 34 provided in a cleaning portion that scrapes the residual toner on the intermediate transfer belt 15.

The primary transfer portion 10 is configured of the primary transfer roll 16 disposed to nip the intermediate transfer belt 15 and oppose the photoreceptor 11. The primary transfer roll 16 is configured of a core member, and a spongy layer which is an elastic layer fixed to the periphery of the core member. The core member is a columnar rod which is made from metal, such as iron or SUS. The spongy layer is a spongy cylindrical roll which is formed of blend rubber of NBR, SBR, and EPDM, in which a conductive agent, such as carbon black, is mixed therein, and in which the volume resistivity is $10^{7.5}$ Ωcm to $10^{8.5}$ Ωcm.

In addition, the primary transfer roll 16 is disposed to nip the intermediate transfer belt 15 and to be pressed to the photoreceptor 11, and further, voltage (primary transfer bias) having polarity (negative polarity, referred to the same in the following) which is opposite to charging polarity of the toner is applied to the primary transfer roll 16. Accordingly, the toner images on each photoreceptor 11 are electrostatically suctioned sequentially to the intermediate transfer belt 15, and the toner images superimposed in the intermediate transfer belt 15 are formed.

The secondary transfer portion 20 is configured to include the rear surface roll 25 and a secondary transfer roll 22 disposed on the toner image holding surface side of the intermediate transfer belt 15.

In the rear surface roll 25, the surface thereof is configured of a tube of blend rubber of EPDM and NBR in which carbon is dispersed, and the inside thereof is made from EPDM rubber. In addition, the surface resistivity is $10^7$ Ω/square to $10^{10}$ Ω/square, and hardness is, for example, set to be 70° (ASKER C: manufactured by Kobunshi Keiki Co., Ltd., referred to the same in the following). The rear surface roll 25 is disposed on the rear surface side of the intermediate transfer belt 15, and configures opposing electrodes of the secondary transfer roll 22, and a metal power supply roll 26 to which the secondary transfer bias is stably applied is disposed to contact with the rear surface roll 25.

Meanwhile, the secondary transfer roll 22 is configured of a core member, and a spongy layer which is an elastic layer fixed to the periphery of the core member. The core member is a columnar rod which is made from metal, such as iron or SUS. The spongy layer is a spongy cylindrical roll which is formed of blend rubber of NBR, SBR, and EPDM, in which a conductive agent, such as carbon black is mixed therein, and in which the volume resistivity is $10^{7.5}$ Ωcm to $10^{8.5}$ Ωcm.

In addition, the secondary transfer roll 22 is disposed to nip the intermediate transfer belt 15 and to be pressed to the rear surface roll 25, and further, the secondary transfer roll 22 is grounded, the secondary transfer bias is formed between the secondary transfer roll 22 and the rear surface roll 25, and the toner image is secondarily transferred onto the paper sheet K transported to the secondary transfer portion 20.

In addition, on the downstream side of the secondary transfer portion 20 of the intermediate transfer belt 15, the residual toner or paper powder on the intermediate transfer belt 15 after the secondary transfer is removed, and an intermediate transfer belt cleaner 35 which cleans the surface of the intermediate transfer belt 15 is provided to be freely come into contact with and separated from the downstream side.

In addition, the intermediate transfer belt 15, the primary transfer portion 10 (primary transfer roll 16), and the secondary transfer portion 20 (secondary transfer roll 22) correspond to an example of the transfer unit.

Meanwhile, on the upstream side of the image forming unit 1Y of yellow, a reference sensor (home position sensor) 42 which generates a reference signal that becomes a reference for the image forming timing in each of the image forming units 1Y, 1M, 1C, and 1K, is installed. In addition, on the downstream side of the image forming unit 1K of black, an image density sensor 43 for performing image quality adjustment is installed.

The reference sensor 42 recognizes a mark provided on a rear side of the intermediate transfer belt 15, generates a reference signal, and each of the image forming units 1Y, 1M, 1C, and 1K starts image forming according to the instruction from the controller 40 based on the recognition of the reference signal.

Furthermore, in the image forming apparatus according to the exemplary embodiment, as the transporting unit which transports the paper sheet K, a paper accommodating portion 50 which accommodates the paper sheet K, a paper feeding roll 51 which takes out and transports the paper sheet K loaded on the paper accommodating portion 50 at a timing determined in advance, a transporting roll 52 which transports the paper sheet K delivered by the paper feeding roll 51, a transporting guide 53 which sends out the paper sheet K transported by the transporting roll 52 to the secondary transfer portion 20, a transport belt 55 which transports the transported paper sheet K to the fixing device 60 after being secondarily transferred by the secondary transfer roll 22, and a fixing inlet guide 56 which guides the paper sheet K to the fixing device 60, are provided.

Next, basic image forming process of the image forming apparatus according to the exemplary embodiment will be described.

In the image forming apparatus according to the exemplary embodiment, with respect to the image data output from an image reading-out device which is not illustrated or a personal computer (PC) which is not illustrated, after the image processing is performed by the image processing device which is not illustrated, image forming work is performed by the image forming units 1Y, 1M, 1C, and 1K.

In the image processing device, with respect to the input reflectance data, the image processing including various types of image editing, such as shading correction, position shift correction, brightness/color space conversion, gamma correction, edge erase or color editing, or moving editing, are performed. The image data to which the image processing is performed, is converted to color material tone data of four colors, such as Y, M, C, and K, and is output to the laser exposure member 13.

In the laser exposure member 13, in accordance with the input color material tone data, for example, each photoreceptor 11 of the image forming units 1Y, 1M, 1C, and 1K is irradiated with the exposure beam Bm emitted from a semiconductor laser. In each photoreceptor 11 of the image forming units 1Y, 1M, 1C, and 1K, after the surface is charged by the charging member 12, the surface is scanned and exposed by the laser exposure member 13, and the electrostatic latent image is formed. The formed electrostatic latent image is developed as the toner images of each color, such as Y, M, C, and K, by each of the image forming units 1Y, 1M, 1C, and 1K.

The toner image formed on the photoreceptor 11 of the image forming units 1Y, 1M, 1C, and 1K are transferred onto the intermediate transfer belt 15 in the primary transfer portion 10 with which each of the photoreceptor 11 and the intermediate transfer belt 15 comes into contact. More specifically, in the primary transfer portion 10, the voltage (primary transfer bias) having polarity which is opposite to charging polarity (negative polarity) of the toner is applied to the base material of the intermediate transfer belt 15 by the primary transfer roll 16, and the primary transfer is performed sequentially overlapping the toner image on the surface of the intermediate transfer belt 15.

After the toner images are sequentially primarily transferred to the surface of the intermediate transfer belt 15, the intermediate transfer belt 15 moves and the toner image is transported to the secondary transfer portion 20. When the toner image is transported to the secondary transfer portion 20, in the transporting unit, the paper feeding roll 51 rotates in accordance with the timing at which the toner image is transported to the secondary transfer portion 20, and the paper sheet K having a target size is fed from the paper accommodating portion 50. The paper sheet K fed by the paper feeding roll 51 is transported by the transporting roll 52, and reaches the secondary transfer portion 20 via the transporting guide 53. Before reaching the secondary transfer portion 20, the paper sheet K is stopped, and as a positioning roll (not illustrated) rotates in accordance with the moving timing of the intermediate transfer belt 15 which holds the toner image, the position of the paper sheet K and the position of the toner image are positioned.

In the secondary transfer portion 20, the secondary transfer roll 22 pressurizes to the rear surface roll 25 via the intermediate transfer belt 15. At this time, the paper sheet K transported in accordance with the timing is nipped between the intermediate transfer belt 15 and the secondary transfer roll 22. At this time, when the voltage (secondary transfer bias) having the same polarity as the charging polarity (negative polarity) of the toner is applied from the power supply roll 26, transfer boundary is formed between the secondary transfer roll 22 and the rear surface roll 25. In addition, the unfixed toner image held on the intermediate transfer belt 15 is integrally electrostatically transferred onto the paper sheet K in the secondary transfer portion 20 pressurized by the secondary transfer roll 22 and the rear surface roll 25.

After this, the paper sheet K to which the toner image is electrostatically transferred is transported maintaining a state of being peeled from the intermediate transfer belt 15 by the secondary transfer roll 22, and is transported to the transport belt 55 provided on the downstream side in the paper transporting direction of the secondary transfer roll 22. In the transport belt 55, in accordance with the most appropriate transporting speed in the fixing device 60, the paper sheet K is transported to the fixing device 60. The unfixed toner image on the paper sheet K transported to the fixing device 60 is fixed onto the paper sheet K by receiving the fixing processing by the heat and pressure by the fixing device 60. In addition, the paper sheet K on which the fixed image is formed is transported to the paper ejection accommodating portion (not illustrated) provided in an output portion of the image forming apparatus.

Meanwhile, after the transfer to the paper sheet K is ended, the residual toner remaining on the intermediate transfer belt 15 is transported to the cleaning portion following the rotation of the intermediate transfer belt 15, and is removed from the intermediate transfer belt 15 by the cleaning rear surface roll 34 and the intermediate transfer belt cleaner 35.

Above, exemplary embodiments of the invention is described, but the invention is not limited to the above-described exemplary embodiments. It is needless to say that various modifications, changes, and improvements are possible within a range that satisfies the requirements of the invention.

EXAMPLES

Hereinafter, the invention will be more specifically described using examples. However, the invention is not limited to the following examples. In addition, in the following description, all of "parts" and "%" are by weight unless otherwise indicated.

Example 1

Endless belt-shaped polyimide (PI) having the diameter of 168 mm, the width of 360 mm, and the thickness of 80 μm, is prepared.

Next, as the liquid silicone rubber composition which is used in the elastic layer, the following silicone rubber composition is prepared.

(A) 100 parts by weight (a degree of polymerization is 700, and the valence of vinyl is 0.025 mol/100 g) of dimethylpolysiloxane in which main chain thereof is composed of a dimethylsiloxane unit and a methylvinylsiloxane unit, in which both molecular chain ends are blocked with trimethylsiloxane groups, and which contains a side chain vinyl group (B) 80 parts by weight of organo-hydrogen polysiloxane, and 30 parts by weight (a degree of polymerization is 17, and an amount of Si—H group is 0.0030 mol/g) of methylhydrogenpolysiloxane having Si—H groups at both ends and in a side chain (C) 0.003 parts by weight of platinic chloride as the heat active catalyst (D) 0.03 parts by weight of (cyclopentadienyl)trimethyl platinum complex which is platinum complex having the cyclic diene compound in ligand as the ultraviolet ray active catalyst (E) 0.03 parts by weight of each of ethynylcyclohexanol and tributyl amine as a reaction control agent The elastic layer forming coating film is formed by coating the prepared PI base material with the elastic layer forming coating liquid of the prepared silicone rubber composition to make the thickness 500 μm by the blade coating method.

The elastic layer forming coating film is placed to be in a semi-cured state by emitting the ultraviolet ray having an accumulated quantity of 5,000 mJ/cm$^2$ by the UV emitting machine from the surface side of the elastic layer forming coating film.

Next, a PFA tube of which the inner surface is improved by the liquid ammonia processing, is prepared. The semi-cured elastic layer forming coating film is coated with the PFA tube, the elastic layer is cured by performing the firing for 1 hour at 200° C. by a hot air oven, and fixing belt of Example 1 is obtained.

Examples 2 to 6

According to Table 1, the fixing belts of Examples 2 to 6 are obtained in the same manner as in Example 1 except that the weight ratio (a/b) of (C) the heat active catalyst and (D) the ultraviolet ray active catalyst is changed.

Example 7

The fixing belt of Example 7 is obtained in the same manner as in Example 3 except that (cyclopentadienyl) trimethyl platinum complex is changed to trimethyl(acetylacetonato) platinum complex which is the β-diketone platinum complex, as (D) the ultraviolet ray active catalyst.

Example 8

The fixing belt of Example 8 is obtained in the same manner as in Example 1 except that a silicone rubber composition into which 10 parts by weight of glycidoxypropyltriethoxysilane is added is used as (F) the adhesiveness imparting component, in the silicone rubber composition prepared in Example 3.

Example 9

The silicone rubber composition used in Example 3 is prepared, and the PI base material is coated with the silicone rubber composition to make the thickness 500 μm by blade coating method.

The elastic layer forming coating film is placed to be in a semi-cured state by firing the member having the provided elastic layer forming coating film for 1 hour at 200° C. by the hot air oven, on the PI base material.

Next, the PFA tube in which the inner surface thereof is improved by the liquid ammonia processing is prepared. The fixing belt of Example 9 is obtained by coating the semi-cured elastic layer forming coating film with the PFA tube, emitting the ultraviolet ray having an accumulated quantity of 5,000 mJ/cm$^2$ by the ultraviolet ray emitting machine from the surface side of the surface layer, curing the semi-cured elastic layer forming coating film, and making the elastic layer.

Comparative Example 1

The fixing belt of Comparative Example 1 is obtained in the same manner as in Example 1 except that the silicone rubber composition which does not contain (C) the heat active catalyst is used in the silicone rubber composition of Example 1.

Comparative Example 2

The fixing belt of Comparative Example 2 is obtained in the same manner as in Example 1 except that the silicone rubber composition which does not contain (D) the ultraviolet ray active catalyst is used in the silicone rubber composition of Example 1.

Comparative Example 3

The elastic layer forming coating film is formed by coating the prepared PI base material with the silicone rubber composition which does not contain (D) the ultraviolet ray active catalyst prepared in Comparative Example 2 to make the thickness 500 μm by the blade coating method. Next, the elastic layer in which the elastic layer forming coating film is cured is formed by performing the firing for 20 minutes at 120° C.

The PFA tube in which the inner surface thereof is improved by the liquid ammonia processing is prepared. The fixing belt of Comparative Example 3 is obtained by coating the cured elastic layer with the PFA tube, and performing the firing for 1 hour at 200° C. by the hot air oven.

Evaluation

Interlayer Peeling Strength Measurement

Samples for experiment of each fixing belt obtained in the examples and the comparative examples, are prepared by cutting out the sample by the width 1.5 cm×the length 10 cm. With respect to the samples, the interlayer peeling strength between the PFA tube which is the surface layer and the elastic layer is measured by a force gauge in a state of being heated on a hot plate. The interlayer peeling strength experiment is performed at belt surface temperature of 200° C., the peeling speed of 2 cm/second, and the peeling direction of 180°. The result is illustrated in Table 1.

Measurement of Non-Uniformity of Thickness of Elastic Layer

The total thickness of each fixing belt obtained in the examples and the comparative examples is measured in an interval of 20 mm in the shaft direction and in an interval of 30° in the circumferential direction by using a digital indicator (manufactured by Mitsutoyo), and the difference between the maximum value and the minimum value is evaluated as the non-uniformity of thickness of elastic layer. The result is illustrated in Table 1.

TABLE 1

| | Elastic layer | | | | Evaluation | | |
|---|---|---|---|---|---|---|---|
| | Heat active catalyst | UV active catalyst | Catalyst weight ratio a/b | Adhesiveness imparting component | Non-uniformity of thickness of Elastic layer (μm) | Interlayer peeling strength (N/15 mm) | Comprehensive determination |
| Example 1 | CPA | $PtCpMe_3$ | 0.1 | Absent | 6 | 1.2 | C |
| Example 2 | CPA | $PtCpMe_3$ | 0.2 | Absent | 6 | 1.4 | B |
| Example 3 | CPA | $PtCpMe_3$ | 1 | Absent | 10 | 1.5 | B |
| Example 4 | CPA | $PtCpMe_3$ | 2 | Absent | 10 | 1.5 | B |
| Example 5 | CPA | $PtCpMe_3$ | 5 | Absent | 20 | 1.5 | C |
| Example 6 | CPA | $PtCpMe_3$ | 6 | Absent | 30 | 1.5 | C |
| Example 7 | CPA | $PtMe_3(acac)$ | 1 | Absent | 10 | 1.7 | A |
| Example 8 | CPA | $PtCpMe_3$ | 1 | GPTES | 10 | 1.8 | A |
| Example 9 | CPA | $PtCpMe_3$ | 1 | Absent | 10 | 1.5 | B |

TABLE 1-continued

| | Elastic layer | | | | Evaluation | | |
|---|---|---|---|---|---|---|---|
| | Heat active catalyst | UV active catalyst | Catalyst weight ratio a/b | Adhesiveness imparting component | Non-uniformity of thickness of Elastic layer (μm) | Interlayer peeling strength (N/15 mm) | Comprehensive determination |
| Comparative example 1 | Absent | $PtCpMe_3$ | — | Absent | 0.6 | 0.6 | D |
| Comparative example 2 | CPA | Absent | — | Absent | 200 | 1.7 | D |
| Comparative example 3 | CPA | Absent | — | Absent | 0.6 | 0.6 | D |

In Table 1, "UV" indicates "ultraviolet ray", "CPA" indicates "platinic chloride", "$PtCpMe_3$" indicates "(cyclopentadienyl)trimethyl platinum complex", "$PtMe_3$(acac)" indicates "trimethyl(acetylacetonato) platinum complex", and "GPTES" indicates "glycidoxypropyltriethoxysilane", respectively.

From the above-described result, it is ascertained that the interlayer peeling strength and the non-uniformity of thickness of elastic layer are excellent in the examples compared to the comparative example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing member comprising:

a base material;

an elastic layer that is provided on the base material, and is made from a cured material of a silicone rubber composition comprising a heat active catalyst and an ultraviolet ray active catalyst; and a surface layer provided on the elastic layer, wherein a weight ratio of an amount of the heat active catalyst to an amount of the ultraviolet ray active catalyst which are contained in the silicone rubber composition, is 0.2 to 5.

2. The fixing member according to claim 1, wherein the silicone rubber composition comprises an adhesiveness imparting component.

3. The fixing member according to claim 1, wherein the ultraviolet ray active catalyst is a β-diketone platinum complex.

4. The fixing member according to claim 2, wherein the ultraviolet ray active catalyst is a β-diketone platinum complex.

5. A fixing device comprising:

a first rotating member; and a second rotating member that is disposed to contact with an outer surface of the first rotating member, wherein at least one of the first rotating member and the second rotating member is the fixing member according to claim 1.

6. An image forming apparatus comprising:

an image holding member;

a charging unit that charges a surface of the image holding member;

a latent image forming unit that forms a latent image on a charged surface of the image holding member;

a developing unit that develops the latent image with a toner to form a toner image;

a transfer unit that transfers the toner image to a recording medium; and a fixing unit that fixes the toner image on the recording medium, and is the fixing device according to claim 5.

7. The fixing member according to claim 1, wherein the heat active catalyst is selected from the group consisting of: platinum group metal including platinum, palladium or rhodium; platinic chloride; alcohol-modified platinic chloride; coordination compound of platinic chloride and vinylsiloxane or acetylene compound of olefin; tetrakis (triphenylphosphine) palladium; and chlorotris (triphenylphosphine) rhodium.

8. The fixing member according to claim 1, wherein the ultraviolet ray active catalyst is selected from the group consisting of: β-diketone platinum complex, including as trimethyl (acetylacetonate) platinum complex, trimethyl (3,5-heptane dionate) platinum complex, trimethyl (methylacetoacetate) platinum complex, bis (2,4-pentane dionato) platinum complex, bis (2,4-hexane dionato) platinum complex, bis (2,4-heptane dionato) platinum complex, bis (3,5-heptane dionato) platinum complex, bis (1-phenyl-1,3-butane dionato) platinum complex, and bis (1,3-diphenyl-1,3-propane dionato) platinum complex; and platinum complex containing cyclic diene compound in ligand, including (methylcyclopentadienyl) trimethyl platinum complex, (methylcyclopentadienyl) trihexyl platinum complex, (trimethylsilylcyclopentadienyl) trimethyl platinum complex, (trimethylsilylcyclopentadienyl) trihexyl platinum complex, (dimethylphenylsilylcyclopentadienyl) triphenyl platinum complex, and (cyclopentadienyl) dimethyltrimethylsilylmethyl platinum complex.

* * * * *